United States Patent [19]

Septor, Sr.

[11] 3,964,425

[45] June 22, 1976

[54] WATER SKI LINE RETRACTOR

[76] Inventor: Nelson C. Septor, Sr., 269 Sunnybrook Road, Springfield, Pa. 19064

[22] Filed: Jan. 27, 1975

[21] Appl. No.: 544,309

[52] U.S. Cl. ..... 114/235 WS; 242/86.5 A
[51] Int. Cl.[2] ..... B63B 21/56
[58] Field of Search ..... 114/235 WS; 115/6.1; 242/86.5 A

[56] References Cited

UNITED STATES PATENTS

| | | | |
|---|---|---|---|
| 2,956,778 | 10/1960 | Weide et al. | 242/86.5 A |
| 3,027,116 | 3/1962 | Holloway | 242/86.5 A |
| 3,063,679 | 11/1962 | Nusbaum | 242/86.5 A |
| 3,100,606 | 8/1963 | Nicholson | 242/86.5 A |
| 3,162,395 | 12/1964 | Bray | 242/86.5 A |
| 3,443,772 | 5/1969 | Prosser | 114/235 WS |
| 3,456,891 | 7/1969 | Parr | 242/86.5 A |

*Primary Examiner*—Trygve M. Blix
*Assistant Examiner*—Charles E. Frankfort
*Attorney, Agent, or Firm*—Weiser, Stapler & Spivak

[57] ABSTRACT

A water ski line retractor which comprises a reverse polarity motor which functions a drive pulley through a worm gear drive. The drive pulley is connected by a belt to a spool pulley which is loosely mounted upon a shaft. A line winding spool fixedly mounts upon the same shaft in side by side juxtaposition to the spool pulley and a clutch is interposed between the line spool and the spool pulley in a manner to permit relative movement of the line spool and the spool pulley. A two way switch controls motor operation in clockwise and counterclockwise direction for automatic line extending the line retrieving purposes.

4 Claims, 4 Drawing Figures

FIG. 1
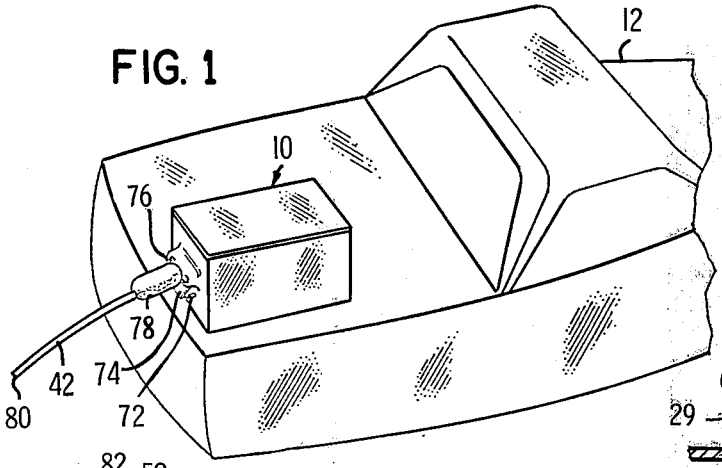
FIG. 4
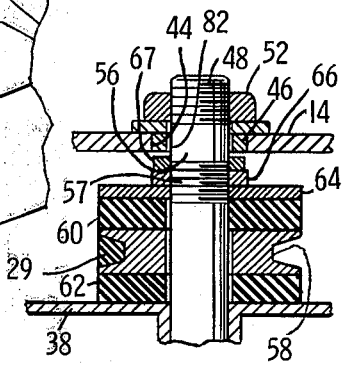
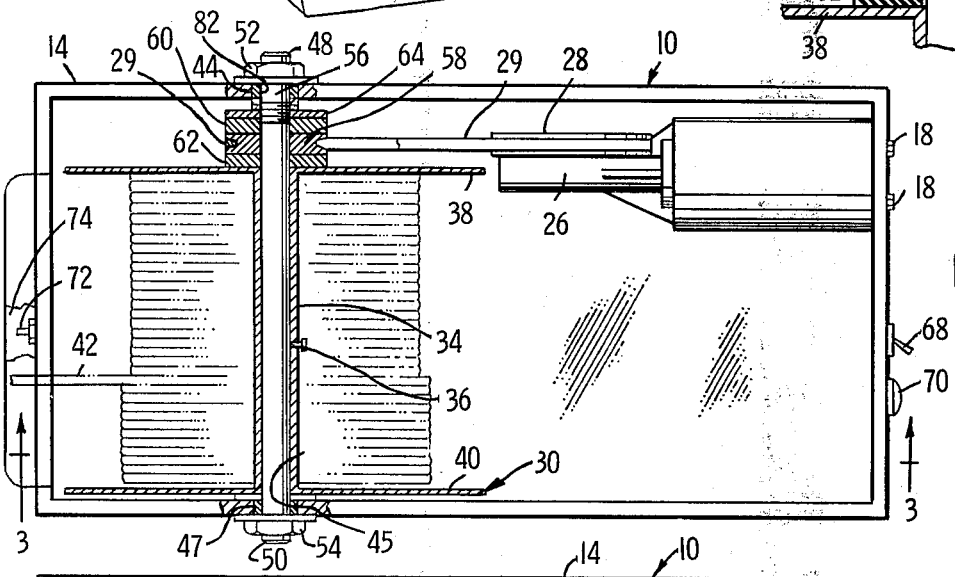
FIG. 2
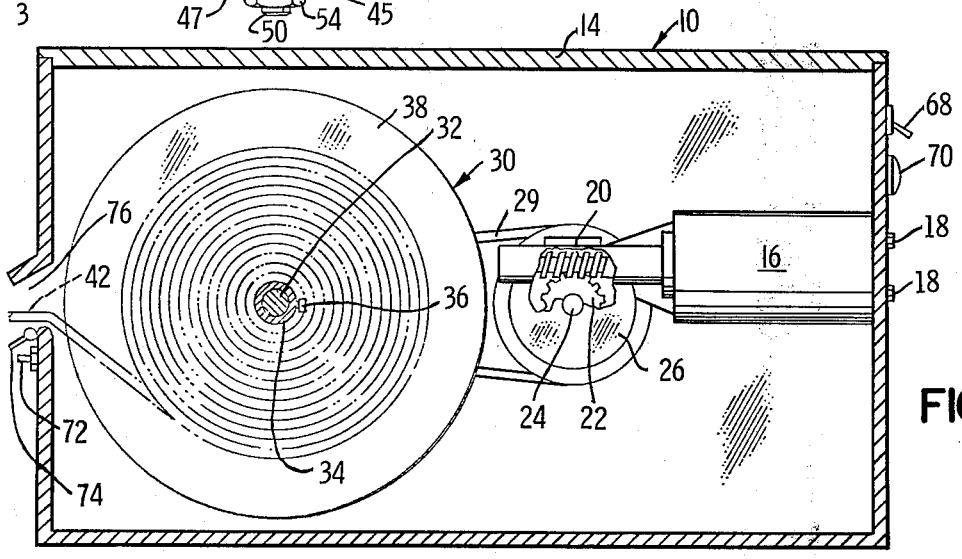
FIG. 3

WATER SKI LINE RETRACTOR

BACKGROUND OF THE INVENTION

The present invention relates generally to the field of water sports, and more particularly, is directed to equipment useful in the sport of water skiing.

Water skiing as a sport has gained great popularity in recent years due primarily to the availability of suitable lightweight, powerful, inboard and outboard motor boats having sufficient speed capability to tow a person through the water on a pair of water skis. To date, most of the design and manufacturing effort in this sport has related particularly to the water skis and related equipment and no satisfactory method has been devised to suitably handle the tow line itself. Most prior workers in the art have simply provided a tow line which is affixed to the boat at one end and has the second end equipped with a wood or plastic handle to enable the skier to easily grip the line for propelling through water while performing the sport of water skiing.

The line itself has conventionally been manually handled so that the line is either played out of the boat or pulled into the boat by hand, thereby resulting in a relatively unsatisfactory and sometimes even unsafe condition. By utilizing such hand operations, the tow line is simply manually piled onto the deck of the boat thereby creating tangled, unsafe footing and other unsatisfactory conditions. Also, when manually playing out such a line, because of the relatively unscientific method of piling the line on the deck, such line has a tendency to snarl, knot and tangle.

Additionally, it should be remembered that the propeller of the boat continuously presents a real hazard to the person in the water and care must always be exercised to assure that the water skier is maintained at a safe distance from the boat propeller. Numerous accidents have been documented when this simple safety rule has not been observed. The presently available equipment has no known method for preventing accidental contact with the moving mechanical parts and accordingly, the person in the water must constantly keep alert.

SUMMARY OF THE INVENTION

The present invention relates generally to the field of water ski equipment, and more particularly, is directed to a novel water ski line retractor that is automatic in operation and which employs a reverse polarity motor.

The present invention includes a large line spool which is affixed to a shaft in a manner to wind or unwind the line from the spool when the shaft is rotated. A spool pulley mounts on the shaft in juxtaposition to the line spool and is rotatable relative to the shaft. A friction type clutch is interposed between the spool pulley and the line spool in a manner to permit the line spool to slip relative to the spool pulley when loaded and to permit the spool pulley to impose sufficient frictional forces for line winding and unwinding when unloaded. The spool pulley is driven through a belt drive in a conventional manner to receive power from a drive pulley. The drive pulley is powered through a worm gear drive by a reverse polarity motor so that the spool pulley can be readily rotated in either a clockwise or counterclockwise direction simply by functioning a two way motor control switch.

When it is desired to play out the line, the reverse polarity motor can be functioned by its switch to turn the spool pulley, which, acting through the clutch in turn rotates the line spool. In order to retrieve the line the switch is functioned in the opposite direction to reverse the direction of rotation of the line spool and to thereby rewind the line. In use, after the unloaded line has been played out a sufficient distance by operation of the motor and the spool pulley to assure that the skier will be a safe distance from the boat propeller, the skier grasps the line in preparation to water skiing. The weight of the skier and the drag through the water is sufficient to overcome the friction imposed at the clutch to thereby unwind the line from the spool even though the motor itself is not functioning. When the line is fully unwound, the water ski equipment will then be operated in the conventional manner. Following completion of the water activites, the skier releases the line and the motor is functioned to turn the line spool through the spool pulley and clutch to automatically wind the line on the line spool.

It is therefore an object of the present invention to provide an improved water ski retractor of the type set forth.

It is another object of the present invention to provide a novel water ski line retractor which incorporates a line spool which can be rotated in either a clockwise or counterclockwise direction by means of a reverse polarity motor.

It is another object of the present invention to provide a novel water ski line retractor that includes a reverse polarity motor, a spool pulley which rotates on a shaft in response to operation of the motor and a line spool mounted on the shaft in juxtaposition to the spool pulley, the motor and spool pulley functioning the line spool for line retrieving and line playing out purposes.

It is another object of the present invention to provide a novel water ski line retractor including a reverse polarity motor, a worm gear drive responsive to the motor for functioning a drive pulley, a spool pulley rotatable about a shaft and being belt driven by the drive pulley, a line spool affixed to the shaft and a clutch interposed between the line spool and the spool pulley to transmit rotative power from the motor to the line spool for line winding and unwinding purposes.

It is another object of the present invention to provide a novel water ski line retractor that includes a reverse polarity motor, a spool pulley responsive to function of the motor, a line spool for playing out and receiving a water ski tow line, a clutch interposed between the spool pulley and the line spool to permit slippage of the line spool relative to the spool pulley when the line is loaded, and means to prevent rotation of the motor when the line spool slips at the clutch relative to the spool pulley.

It is another object of the present invention to provide a novel water ski line retractor that is rugged in construction, inexpensive in manufacture and trouble free when in operation.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view showing the invention affixed to a portion of a boat.

FIG. 2 is an enlarged top plan view of the invention.

FIG. 3 is a cross sectional view taken along line 3—3 of FIG. 2, looking in the direction of the arrows and partially broken away to expose interior construction details.

FIG. 4 in an enlarged, partial sectional view of the clutch mechanism.

DESCRIPTION OF THE PREFERRED EMBODIMENT OF THE INVENTION

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a water ski line retractor 10 which is securely bolted or otherwise permanently affixed to a conventional power boat 12 of the type normally employed for recreational water skiing purposes. The water ski line retractor 10 should preferably be secured to the stern of the boat 12 to provide optimum utility.

As seen in FIGS. 2 and 3, the water ski line retractor 10 comprises an enclosing structural casing 14 which is preferably fabricated of steel, aluminum or other sheet material having sufficient strength to maintain the working parts of the apparatus in operable arrangement. A low voltage motor 16, for example a motor wound for twelve volt operation, is securely mounted upon the casing 14 by employing a plurality of threaded fasteners 18 in well known manner. Preferably, the motor 16 is of the reverse polarity type, to facilitate playing out and retracting the line 42 and is wound to draw operating power from the usual battery (not shown), which is normally employed for boat engine (also not shown) starting purposes. The motor 16 conventionally functions a straight worm gear 20 which meshes with a drive gear 22 to rotate the power shaft 24 upon function of the motor. The gears 20, 22 are preferably mounted within a closed housing 26 to facilitate lubrication of the gears and to prevent the entrance of moisture, dirt, etc. A drive pulley 28 is pinned or otherwise securely affixed to the drive shaft 24 in a manner to assure rotation of the drive pulley 28 upon rotation of the shaft 24 when the motor 16 is functioned. An endless belt 29 interconnects the drive pulley with the spool pulley 58 to transmit rotative power from the motor shaft to the spool shaft 32 through a frictional clutch.

Still referring to FIGS. 2 and 3, I show a large spool 30 which is mounted upon the spool shaft 32 in a manner to rotate the spool shaft 32 when the spool 30 is rotated. The spool 30 includes a hollow spindle 34 which overfits the spool shaft 32 and is securely affixed thereto in conventional manner, such as by employing a set screw 36. The hollow spindle 34 transversely terminates at each end in discoid head 38, 40 which heads serve to retain the ski tow line 42 thereon. The spool shaft 32 positions through a pair of transversely aligned openings 44, 45 which are provided in the casing 14 for spool support purposes. Preferably, the openings 44 are equipped with the bushings 46, 47 to facilitate shaft rotation upon function of the motor 16 as hereinafter more fully set forth. The spool shaft 32 is endwardly provided with right and left bearing surfaces and a pair of opposed, threaded ends 48, 50 which respectively receive the nuts 52, 54. The bearing surfaces 82, 84 respectively revolve within the bushings 46, 47 and the nuts 52, 54 serve to retain the spool shaft 32 in operative position relative to the casing 14.

As seen in FIGS. 2 and 4, the spool shaft 32 extends laterally beyond one spool head 38 to provide a threaded shaft extension 56 upon which is mounted a spool pulley 58 and a pair of friction clutch disks 60, 62. The friction clutch disks 60, 62 are mounted on each side of the spool pulley 58 and are fabricated of a resilient, high friction material, such as rubber or fiber, of suitable characteristics to permit employment for clutch purposes. A friction washer 64 overfits the spool shaft extension 56 endwardly of the outer clutch disc 60 to cooperate with a threaded nut 66 which preferably is integrally formed with the friction washer 64. The nut 66 threadedly turns upon the threaded shaft extension 56 for clutch friction adjusting purposes. When the nut 66 is turned in a direction to force the friction washer 64 against the friction clutch disk 60, the opposite face of the disk 60 bears against the spool pulley 58 to force the pulley 58 against the inner friction clutch disk 62. The inner surface of the friction clutch 62 bears against the spool head 38 to thereby frictionally engage the spool 30 to cause the spool to revolve when the spool pulley 58 is rotated upon operation of the motor 16. By tightening or loosening the nut 66, the degree of frictional engagement of the spool pulley 58 to the large spool 30 can be readily adjusted to suit existing conditions. If desired, a lock nut 67 can be threaded onto the shaft extension 56 exteriorly of the threaded nut 66 to lock the nut 66 in the desired position.

The friction clutch disks 60, 62 permit the water ski line retractor 10 to serve a useful function as a safety device to prevent possible contact between the water skier and the boat's propeller (not shown). In operation once suitable frictional engagement has been established between the friction clutch disks 60, 62, the spool pulley 58 and the large spool 30, by adjusting the threaded nut 66 and the lock nut 67, the motor switch 68 will be pushed to a first position to function the motor 16 in a direction to play out the line 42 by turning the large spool to unwind the line 42. After the line 42 has been played out, a distance of approximately ten feet or more so that the swimmer will not be in the vicinity of the boat 12, the skier (not shown) can grasp the tow end 80 of the line 42 and the operator of the boat can propel the boat forwardly through the water without danger of an accident. The weight of the skier will overcome the frictional engagement of the clutch disks 60, 62 between the spool pulley 58 and the large spool 50 to thereby allow the large spool to slip relative to the spool pulley 58 to thereby play out the line 42 without additional function of the motor 16. When the line 42 is completely played out, there will be no further rotative action of the large spool 30 and water skiing can proceed in the usual manner. In order to retract the line, the switch 68 is pushed to its reverse position to reverse the direction of operation of the motor 16, the worm gear 20, and the drive gear 22. The drive pulley 28 functioning through the belt 29 then turns the spool pulley 58 to rewind the line 42. It will be noted that the line will thus be retracted automatically by function of the motor 16, once the weight of the skier (not shown) has been released from the line.

In a preferred embodiment, the line 42 functions through an opening 76 which is provided in the casing 14. The opening 76 is transversely elongated to facilitate even winding of the line 42 upon the large spool

30. The bottom portion of the opening 76 may be equipped with a hinged cover 74 or similar construction which is in continuous contact with a conventional push type electrical switch. In order to function the switch 72, I provide a conventional line float 78 on the line 72 approximately 10 or 12 feet from the tow end 80 thereof. In one embodiment the switch 72 can be wired to monitor a pilot light 70 which is conventionally wired in series with the motor 16. Thus, when the motor 16 is functioned in either direction by means of the switch 68, the pilot light 70 will light to indicate to the operator (not shown) that the device is properly functioning. When the line 42 is retracted until the float 78 contacts the hinged cover 74, continued function of the motor 16 will pull the float 78 against the hinged cover 74 in a manner to depress the switch 72 to thereby extinguish the pilot light 70. When the pilot light is inoperative, the operator will automatically be signalled that the line is substantially completely retracted and he can thereby cease motor operation by releasing the switch 68. In a second embodiment, as a safety feature, the switch 72 can be wired directly in series with the motor 16 to thereby automatically stop the motor 16 upon contact of the float 78 with the hinged cover. In this manner, automatic means are provided to always assure that the tow end 80 of the line 42 is maintained at least 10 or 12 feet from the boat 12 so that the water skier need not approach closer to the boat at any time.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a water ski line retractor to vary the distance between the tow end of a ski line and a boat, the combination of A. a frame;

B. a motor mounted upon the frame,

C. a spool shaft rotatably mounted upon the frame in spaced relationship from the motor, 1. a spool pulley mounted on said spool shaft and being rotatable by said motor for spool rotating purposes;

2. said spool pulley including means to permit the spool shaft to rotate relative to said spool pulley;

D. a spool mounted upon the spool shaft, 1. said water ski line winding upon and unwinding from the spool in response to operation of the motor, 2. said spool being connected to the spool shaft by means to prevent rotation of the spool relative to the spool shaft; and E. first friction clutch means interposed between the spool pulley and the spool to permit the spool to slip relative to the spool pulley upon the application of a drag weight to the water ski line.

2. The water ski line retractor of claim 1 including second friction clutch means interposed between said spool pulley and said frame, said second friction clutch means comprising a friction washer overfitting the spool shaft, a friction clutch disk interposed between the friction washer and the spool pulley and adjustment means to urge the friction clutch disk into frictional engagement with the spool pulley.

3. The water ski line retractor of claim 2 wherein the first friction clutch means comprises a second friction clutch disk overfitting the spool shaft, the second clutch disc being interposed between the spool pulley and the spool.

4. The water ski line retractor of claim 3 wherein the adjustment means comprises means to urge the second clutch disk into frictional engagement with the spool to rotate the spool when the motor is energized.

* * * * *